US007991180B2

(12) United States Patent
Moon

(10) Patent No.: US 7,991,180 B2
(45) Date of Patent: Aug. 2, 2011

(54) TACTILELY IDENTIFIABLE EARPHONES

(76) Inventor: Eric E. Moon, London (GB)

( * ) Notice: Subject to any disclaimer, the term of this patent is extended or adjusted under 35 U.S.C. 154(b) by 1317 days.

(21) Appl. No.: 11/491,446

(22) Filed: Jul. 21, 2006

(65) Prior Publication Data

US 2008/0019556 A1 Jan. 24, 2008

(51) Int. Cl.
*H04R 25/00* (2006.01)

(52) U.S. Cl. ..... 381/380; 381/328

(58) Field of Classification Search ..... 381/23.1, 381/309, 322, 328, 380, 381, 382; 181/129, 181/130, 135; 128/864
See application file for complete search history.

(56) References Cited

U.S. PATENT DOCUMENTS 6,688,421 B2 * 2/2004 Dyer et al. ..... 181/130
6,830,124 B2 * 12/2004 Chiang ..... 181/135

* cited by examiner

*Primary Examiner* — Huyen D Le

(74) *Attorney, Agent, or Firm* — Greenberg Traurig, LLP

(57) ABSTRACT

The present invention is directed to earphone apparatus having a first earphone and a second earphone. The apparatus also includes a distinguishing mechanism for distinguishing the first earphone from the second earphone by the touch of a user.

21 Claims, 1 Drawing Sheet

TACTILELY IDENTIFIABLE EARPHONES

FIELD OF THE INVENTION

The present invention relates to earphones and, more particularly, to earphones which are distinguishable from one another by the touch of a user.

BACKGROUND OF THE INVENTION

Earphones that are constructed for insertion into (and removal from) the outer portions of ear canals, are frequently supplied with electronic entertainment equipment (e.g., portable radios and playback devices). The left earphone is adapted for removable insertion into the left ear, while the right earphone is adapted for removable insertion into the right ear. Typically, a user visually identifies the left and right earphones in order to properly insert the left and right earphones into his/her left and right ears, respectively.

When the user is exercising (e.g., riding a bicycle or running) and wishes to insert earphones into his/her ears while continuing to exercise, the aforesaid visual identification procedure can distract the user and contribute to an accident and/or injuries. The aforesaid visual identification is also impossible when the earphones are used in the dark or if the user suffers from presbyopia or other visual impairment. What is needed, but has yet to be provided, are earphones which are distinguishable from each other by the touch of a user.

SUMMARY OF THE INVENTION

The present invention overcomes the disadvantages and shortcomings of the prior art discussed above by providing earphone apparatus having a first earphone and a second earphone. The apparatus also includes a distinguishing mechanism for distinguishing the first earphone from the second earphone by the touch of a user.

BRIEF DESCRIPTION OF THE DRAWINGS

For a more complete understanding of the present invention, reference is made to the following detailed description of an exemplary embodiment considered in conjunction with the accompanying drawing, in which.

DETAILED DESCRIPTION OF THE INVENTION

Figure 1:
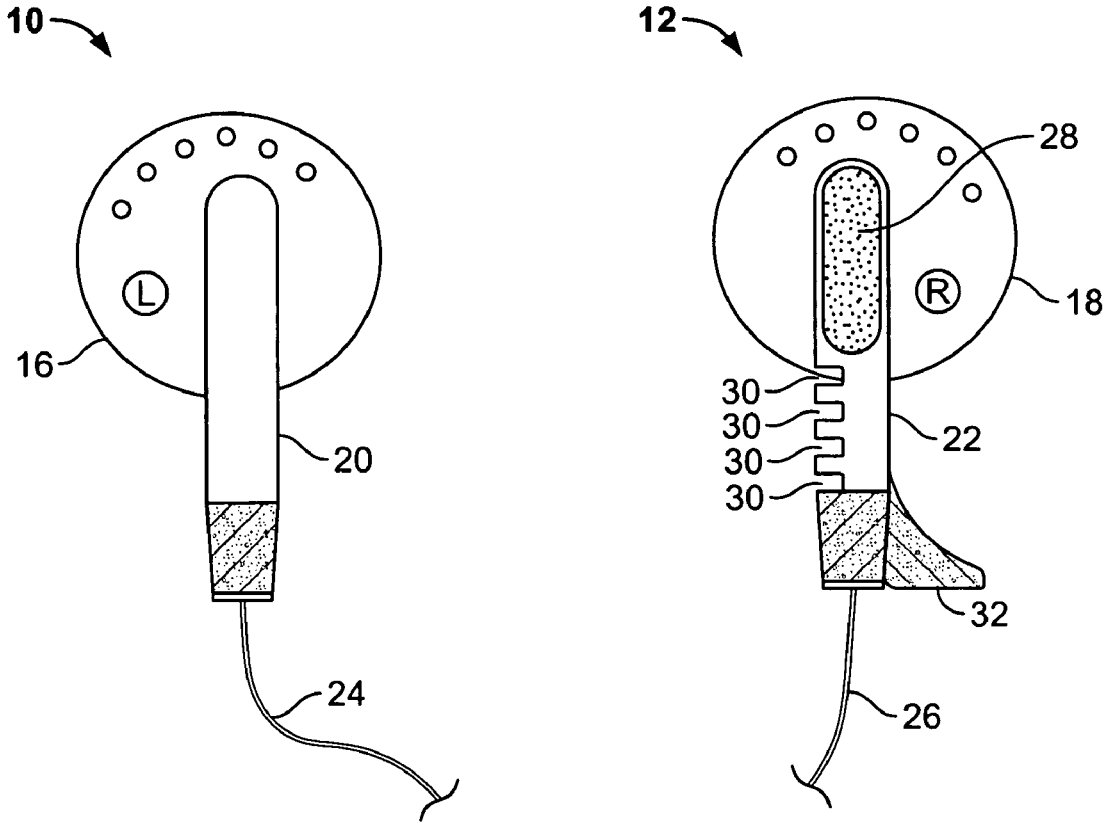
FIG. 1 is a schematic view of a set of earphones constructed in accordance with the present invention.

FIG. 1 illustrates a set of earphones 10, 12 constructed in accordance with the present invention. More particularly, the earphone 10 is adapted to be inserted into the left ear of a user, while the earphone 12 is adapted to be inserted into the user's right ear. As can be seen in FIG. 1, the basic construction of each of the earphones 10, 12 is similar to the basic construction of a conventional earphone. For instance, the earphones 10, 12 include housings 16, 18, respectively, each of which houses therein a conventional electronic and/or electronic component or components (not shown) adapted to produce audible sounds. Moreover, the earphones 10, 12 also include elongated bodies 20, 22 which are attached to the housings 16, 18, respectively, and cables 24, 26, which extend through the elongated bodies 20, 22, respectively, and are connected to the electrical/electronic components of the housings 16, 18, respectively. The elongated bodies 20, 22 are sized and shaped so as to be grasped by the fingers of the user in removably inserting the earphones 10, 12, respectively, into the left and right ears of the user. Once inserted, the earphones 10, 12 project sounds in a conventional manner into the left and right ears, respectively.

Still referring to FIG. 1, the earphone 12 includes at least one tactile feature for allowing a user to readily distinguish between the earphone 12 and the earphone 10 by touch (i.e., without a visual inspection of the earphones 10, 12 by the user). For instance, the tactile feature can be in the form of a sandpaper-like member 28, which is attached to the elongated body 22 and/or the housing 18. The member 28 includes a surface texture such that when sensed by a user, it provides a distinct tactile sense (e.g., a sandpaper-like feel) to the user so as to indicate that the earphone touched by him/her is the right earphone. The tactile feature can also be in the form of a plurality of grooves 30, which are formed in the elongated body 22 and/or the housing 18, and a rib-like member 32, which is attached to the elongated body 22 and projecting outwardly therefrom. Like the member 28, the grooves 30 and the member 32 each function to provide a distinct tactile sense to the user so as to indicate that the earphone is a right earphone. Because the earphone 12 is provided with the member 28, the grooves 30 and/or the member 32, the user can easily distinguish the earphone 12 from the earphone 10 and insert them into the correct ears without visually inspecting the earphone 12 or the earphone 10.

As shown in FIG. 1, the earphone 12 can include all of the member 28, the grooves 30 and the member 32. Alternatively, the earphone 12 can include only one of the member 28, the grooves 30 and the member 32. In addition, the earphone 10 can include one or more tactile features or members, which are different from the tactile feature or features provided on the earphone 12, so as to indicate that the earphone 10 is a left earphone. Alternatively, tactile features or members can be provided only on the earphone 12.

It will be understood that the embodiment described herein is merely exemplary and that a person skilled in the art may make many variations and modifications without departing from the spirit and scope of the invention. For instance, the number, location, shape, orientation and/or surface texture of the tactile features may vary infinitely. Accordingly, any member, feature or structure (e.g., dimples, swirls, pins, dots, etc.) that provides a distinct tactile sense to a user can be utilized in connection with the present invention. All such variations and modifications are intended to be included within the scope of the invention as defined in the appended claims.

I claim:

1. Earphone apparatus comprising a first earphone and a second earphone, each of said first and second earphones including a housing, which is sized and shaped so as to house therein an electrical component and be insertable in a user's ear, and an elongate body, which extends downwardly from a corresponding one of said housings of said first and second earphones; and distinguishing means for distinguishing said first earphone from said second earphone by the touch of a user, said distinguishing means being provided on only one of said first and second earphones, said distinguishing means being fixedly provided on said one of said first and second earphones and including a rib projecting laterally outwardly from said elongate body of said one of said first and second earphones, said rib having a point at one end thereof and being fixedly attached at an opposite end thereof to said elongate body of said one of said first and second earphones.

2. The apparatus of claim 1, wherein said distinguishing means includes a plurality of grooves formed in said elongate body of said one of said first and second earphones.

3. The apparatus of claim 2, wherein said distinguishing means further includes a textured surface fixedly provided on said elongate body of said one of said first and second earphones.

4. The apparatus of claim 1, wherein said rib has an arcuate edge along one side thereof and a substantially straight edge along an opposite side thereof.

5. The apparatus of claim 4, wherein said rib has a substantially triangular shape.

6. The apparatus of claim 1, wherein said rib provides a distinct tactile sense to a user when touched by the user such that said first earphone can be distinguished from said second earphone by touch only.

7. The apparatus of claim 1, further comprising another distinguishing means for distinguishing said first earphone from said second earphone by the touch of a user, said another distinguishing means being fixedly provided only on the other one of said first and second earphones.

8. Earphone apparatus comprising a first earphone and a second earphone, each of said first and second earphones including a housing, which is sized and shaped so as to house therein an electrical component and be insertable in a user's ear, and an elongate body, which extends downwardly from a corresponding one of said housings of said first and second earphones; and distinguishing means for distinguishing said first earphone from said second earphone by the touch of a user, said distinguishing means being provided on only one of said first and second earphones, said distinguishing means being fixedly provided on said one of said first and second earphones and including a plurality of grooves formed in said elongate body of said one of said first and second earphones.

9. The apparatus of claim 8, wherein said grooves provide a distinct tactile sense to a user when touched by the user such that said first earphone can be distinguished from said second earphone by touch only.

10. The apparatus of claim 9, wherein said distinguishing means further includes a textured surface attached to said elongate member of said one of said first and second earphones to provide a distinct tactile sense to a user.

11. The apparatus of claim 10, wherein said distinguishing means further includes a rib projecting outwardly from said elongate body of said one of said first and second earphones.

12. The apparatus of claim 8, further comprising another distinguishing means for distinguishing said first earphone from said second earphone by the touch of a user, said another distinguishing means being fixedly provided only on the other one of said first and second earphones.

13. The apparatus of claim 8, wherein said distinguishing means further includes a rib projecting laterally outwardly from said elongate body of said one of said first and second earphones.

14. The apparatus of claim 8, wherein said plurality of grooves includes first and second grooves, which are formed in said elongate body of said one of said first and second earphones and extend laterally across said elongate body of said one of said first and second earphones.

15. The apparatus of claim 14, wherein said plurality of grooves also includes third and fourth grooves, which are formed in said elongate body of said one of said first and second earphones and extend laterally across said elongate body of said one of said first and second earphones.

16. The apparatus of claim 15, wherein said plurality of grooves are aligned in a stacked, spaced relationship.

17. Earphone apparatus comprising a first earphone and a second earphone, each of said first and second earphones including a housing, which is sized and shaped so as to house therein an electrical component and be insertable in a user's ear, and an elongate body, which extends downwardly from a corresponding one of said housings of said first and second earphones; and distinguishing means for distinguishing said first earphone from said second earphone by the touch of a user, said distinguishing means being provided on only one of said first and second earphones, said distinguishing means being fixedly provided on said one of said first and second earphones and including a textured surface fixedly provided on said elongate body of said one of said first and second earphones, said textured surface being a sandpaper member.

18. The apparatus of claim 17, wherein said distinguishing means further includes a plurality of grooves formed in a said elongate body of said one of said first and second earphones.

19. The apparatus of claim 17, wherein said distinguishing means further includes a rib projecting outwardly from a said elongate body of said one of said first and second earphones.

20. The apparatus of claim 17, wherein said sandpaper member provides a distinct tactile sense to a user when touched by the user such that said first earphone can be distinguished from said second earphone by touch only.

21. The apparatus of claim 17, further comprising another distinguishing means for distinguishing said first earphone from said second earphone by the touch of a user, said another distinguishing means being fixedly provided only on the other one of said first and second earphones.

* * * * *